United States Patent [19]

Prasad

[11] Patent Number: 4,526,221

[45] Date of Patent: Jul. 2, 1985

[54] CRUCIBLE FOR USE WITH BROKEN ARM-TYPE CENTRIFUGAL CASTING MACHINE

[75] Inventor: Arun Prasad, Cheshire, Conn.

[73] Assignee: Futurdent Industries Inc., New Brunswick, N.J.

[21] Appl. No.: 573,146

[22] Filed: Jan. 23, 1984

[51] Int. Cl.[3] ..... B22D 13/10; B22D 13/06

[52] U.S. Cl. ..... 164/289; 164/335

[58] Field of Search ..... 164/286, 287, 289, 290, 164/335, 336, 337; 266/204, 275

[56] References Cited

U.S. PATENT DOCUMENTS

| | | | |
|---|---|---|---|
| 1,778,652 | 10/1930 | Wilson | 164/287 |
| 2,004,457 | 6/1935 | Beringer | 164/287 X |
| 4,058,155 | 11/1977 | Eash | 164/289 X |

*Primary Examiner*—Nicholas P. Godici
*Assistant Examiner*—Kenneth F. Berg
*Attorney, Agent, or Firm*—Watson, Cole, Grindle & Watson

[57] ABSTRACT

A crucible for use with a broken arm-type centrifugal casting machine includes an elongated base section and a top section which is generally in the shape of a half cylinder, a large portion of the top section being removed by a cavity which creates a crucible floor, left and right side walls and a generally funnel-shaped channel which extends to a front surface at the front end of the crucible to provide a discharge opening. The right side wall is always correspondingly higher than the left side wall and both the left side wall and the right side wall increase in height and slope over toward one another as they extend toward the front end of the crucible until they merge at a point on a head portion of the top section which is on the left side of the crucible. The crucible floor includes a portion which narrows in width as it extends toward the front end of the crucible and slopes downwardly from horizontal at an angle of between about 10° and 20°, and another portion which also narrows in width as it extends toward the front end of the crucible and slopes downwardly from horizontal at an angle of between about 2° and 6° and concurrently downwardly from horizontal toward the right side of the crucible at an angle of between about 2° and 6° so as to provide a lowermost area of the crucible floor in the noted head portion.

9 Claims, 11 Drawing Figures

CRUCIBLE FOR USE WITH BROKEN ARM-TYPE CENTRIFUGAL CASTING MACHINE'

BACKGROUND OF THE INVENTION

1. Field of the Invention

The present invention relates to a crucible for use in the melting of metallic materials, and more particularly to a crucible which can be used with a broken arm-type centrifugal casting machine to contain metallic material as it is melted and to then deliver the molten metallic material to an associated casting mold upon the application of inertial and centrifugal forces.

2. The Prior Art

Centrifugal casting machines are well known devices which are used for the casting of small metallic objects. Such casting machines require the use of a crucible which is mounted on the rotatable casting arm of the casting machine so as to be in an operative position with respect to a casting mold, the crucible functioning to support the metallic material (which is to be used in forming the desired object) as it is melted by the flame from a torch and to then discharge the molten metallic material through a channel into the casting mold as the casting arm is rotated. Crucibles for use on centrifugal casting machines have been fabricated in many different shapes—see, for example, U.S. Pat. Nos. 1,778,652; 2,006,148; 2,438,817; 2,847,738; 3,371,705; and 3,648,762.

A currently preferred type of centrifugal casting machine one that is used by many dentists for forming dental prostheses for their patients—is the broken arm-type centrifugal casting machine. In this machine, both the crucible for supporting and housing the metallic material to be cast and the casting mold in which the metallic material is to flow are mounted on a swing arm which is in turn pivotally mounted at one end of a rotatable casting arm. When in its rest positioning the swing arm will be oriented such that the crucible and the casting mold will be aligned along a line generally tangent with respect to the circle of rotation defined by the adjacent end of the casting arm (the casting mold will be behind the crucible with respect to the direction of rotation of the casting arm, which is always counterclockwise), and as the casting arm is caused to commence rotation, the molten metallic material in the crucible will, as a result of inertial forces, commences flowing into the casting mold. After the casting arm has rotated a short distance (note: its rotational velocity will increase rapidly after commencement of rotation), and after a locking device has been released, the centrifugal forces on the casting mold will cause the swing arm to rotate relative to the end of the casting arm such that the casting mold and the crucible become radially oriented along the line defined by the casting arm. Because the casting mold will be radially outwardly of the crucible, the molten metallic material which has passed into the casting mold will then be centrifugally forced to completely fill the molding space in the casting mold, thus providing a better made product. A centrifugal casting machine of this type is shown, for example, in U.S. Pat. No. 4,130,158.

Although the known crucibles which have been used in conjunction with conventional broken arm-type centrifugal casting machines have been more or less acceptable when used in casting precious metals, they have proven to be insufficient when the casting machines have been used to cast non-precious metals. In this regard, dentists have turned to the use of low gold or non-gold-containing metallic alloys for making their patients' protheses, not only to reduce costs, but to avoid the uncertainties resulting from the daily fluctuations in the prices of the gold and platinum-group metals. However, such non-precious metallic alloys display a lower specific gravity than the conventionally used precious metals, so when they are cast in a broken arm-type centrifugal casting machine, the speed of rotation of the casting arm must be made extremely high so as to provide sufficient inertial and centrifugal forces on the metallic alloys to force them to move out of the supporting crucible and into the casting mold, i.e., so as to fully occupy the molding space in the casting mold. The known crucibles are not fully adequate in this regard, in particular because they do not adequately prevent the non-precious metallic materials therein from splashing out of the crucibles as they are rapidly rotated. Thus results in the unwanted loss of relatively expensive metallic material and/or the production of faulty products.

It is thus an object of the present invention to provide a crucible which can be used to mold non-precious metallic materials in a broken arm-type centrifugal casting machine, i.e., in situations where the casting arms thereof are rotated at extremely high speeds, and which is constructed to prevent loss of the contained molten metallic material due to splashing.

SUMMARY OF THE INVENTION

A crucible which satisfies the objects of the present invention includes an elongated base section and a top section which is generally in the shape of a half cylinder, and it includes a cavity which extends from the rear end of the crucible to its front end and in effect removes a large portion of the top section to create a crucible floor, left and right side walls and a generally funnel-shaped channel which extends through a head portion of the top section to provide a discharge opening in the front surface of the crucible. The discharge opening is centered on an imaginary vertical plane which divides the crucible in half in its longitudinal dimension. The right side wall is always correspondingly higher than the left-side wall; at the same time, both the left-side wall and the right-side wall increase in height as they extend toward the front end of the crucible and they concurrently slope over toward one another until they merge at a point on the head portion which is on the left-side of the imaginary vertical line. Thus, the right-side wall provides a greater enclosure over the crucible floor than does the left-side wall.

The crucible floor, which extends from the rear end of the crucible to a point within the noted head portion of the top section, is contoured to provide a generally horizontal first portion, a generally flat second portion, and a generally flat third portion. The second portion narrows in width as it extends toward the front end of the crucible, and it concurrently slopes downwardly at an angle of between about 10 and 20° from horizontal (this is much less than in prior art crucibles wherein the equivalent angle is 30° and higher). The third portion also narrows in width as it extends toward the front end of the crucible, and it concurrently slopes downwardly from horizontal, both in the direction of the front end of the crucible and also toward the right side of the crucible, both of these angles ranging from about 2 to 6° downwardly from horizontal. The third floor portion provides a lowermost area of the crucible floor which is located on the right side of the crucible (to the right of the imaginary vertical plane dividing it in half) and within the noted head portion of the top section.

Due to the contour of the crucible floor and that of the left and right-side walls, the metallic material placed therein will be quickly and easily heated by a flame directed toward it from the rear end of the crucible when the crucible is at rest; at the same time, when the crucible is moved by the casting machine during the casting operation, the molten metal will smoothly flow through the generally funnel-shaped channel and into the casting mold with a minimum of turbulence and no loss of material due to splashing.

A further understanding of the invention will now be had by reference to the accompanying drawings, taken in conjunction with the ensuing discussion.

DETAILED DESCRIPTION OF THE PREFERRED EMBODIMENTS

Figure 1:
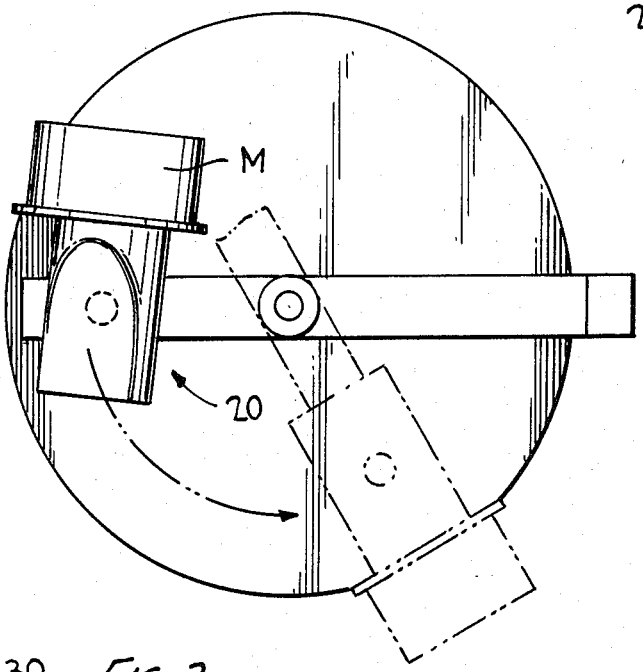
FIG. 1 shows a perspective view of a crucible according to a first embodiment of the present invention.
Figure 2:
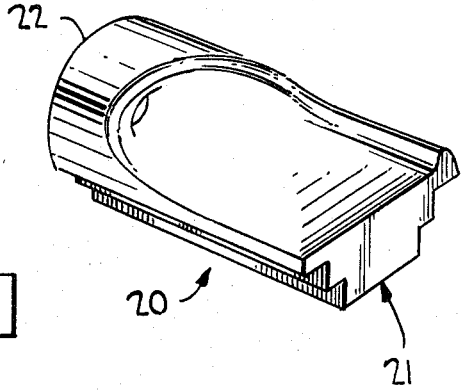
FIG. 2 shows a schematic representation of the crucible of FIG. 1 mounted on a casting arm of a broken arm centrifugal casting machine.

A crucible according to a first preferred embodiment of the present invention is shown in FIGS. 1 and 3–8. This crucible, which is generally indicated by reference numeral 20, is adapted to be mounted on a broken arm-type centrifugal casting machine and is used to support metallic materials and transfer them to a casting mold as the casting machine is operated. In this regard, FIG. 2 shows the crucible 20 mounted in association with a casting mold M on the swing arm which is pivotally mounted at the end of a casting arm of a broken arm-type centrifugal casting machine. The crucible 20 and the casting mold M are depicted in solid lines in their orientation prior to commencement of rotation of the casting arm and in phantom in their orientation after the casting arm has rotated counterclockwise as shown by the arrow.

The crucible 20, which is made of the usual thermally shock-resistant materials such as fused silica, silicon carbide, high alumna, etc., is unitary in structure; however, for purposes of description it can be said to be composed of an elongated base section 21 and a top section 22, the top section 22 being generally in the form of a half cylinder (note: although the top section 22 is herein described as being in the general shape of a half cylinder, it actually has a large portion thereof removed, as will be discussed below). The base section 21 and the top section 22 provide the crucible with a generally vertical front surface 23 at its front end (the terms vertical and horizontal will be used to describe features of the crucible on the premise that the crucible is oriented in its operative position on a broken arm-type centrifugal casting machine), a generally vertical rear surface 24 at its rear end, a generally horizontal bottom surface 25, parallel left and right sides 26 and 27, and a curved top surface 28. The top section 22 is wider than the base section 21 such that steps $S_1$ are provided along both sides of the crucible 20. In addition, the base section 21 includes indented steps $S_2$ along its opposite sides. The indented steps $S_1$ and $S_2$ on the opposite sides of the crucible enable it to be mounted on the crucible support rails of the swing arm of a broken arm-type centrifugal casting machine.

Extending along the crucible from its rear end to its front end and so as to result in removal of a large portion of the top section 22 is a cavity which creates an exposed crucible floor 29, a left-side wall 30 (formed from an outer portion of the top section 22), a right-side wall 31 (formed from an outer portion of the top section 22) and a generally funnel-shaped channel C (formed for the most part by an inner surface within a head portion 32 of the top section 22). The channel C extends to the front surface 23 of the crucible so as to provide a circular discharge opening 33, which is centered with respect to an imaginary vertical plane X which divides the crucible in half in its longitudinal dimension (see FIGS. 3 and 6–8).

Figure 3:
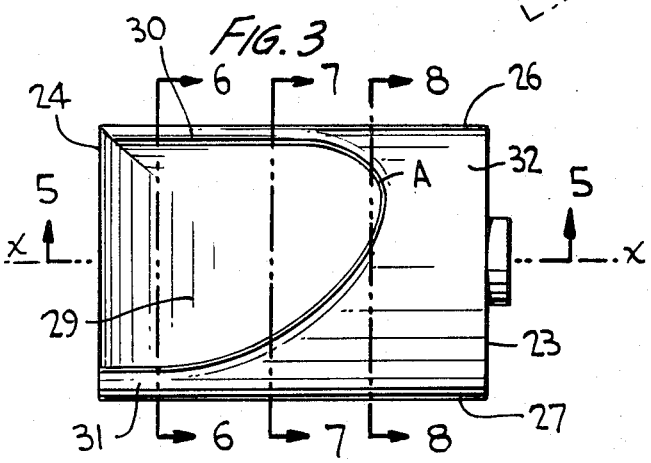
FIG. 3 shows a plan view of the crucible of FIG. 1.
Figure 4:
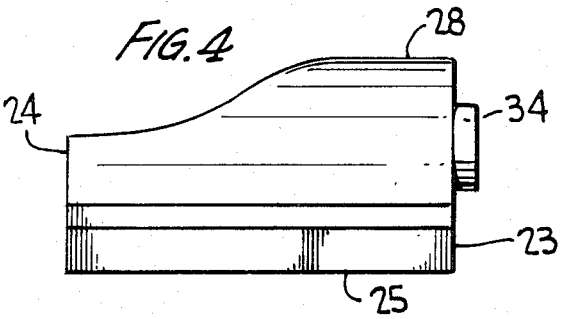
FIG. 4 shows a right side elevational view of the crucible of FIG. 1.
Figure 5:
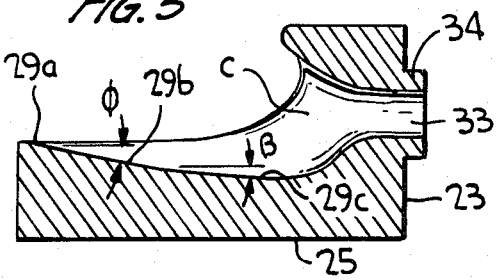
FIG. 5 shows a cross-section through the crucible of FIG. 3 as seen along line 5—5.

As can be seen in FIGS. 3–5, the crucible 20 also includes a ring-like nose 34 which extends forwardly of the front surface 21 and is aligned with the discharge opening 33. The ring-like nose 34 has an inner diameter which is equal to that of the discharge opening. The nose 34 provides an enclosed passageway from the discharge opening 33 to the inlet opening of a casting mold.

Figure 6:
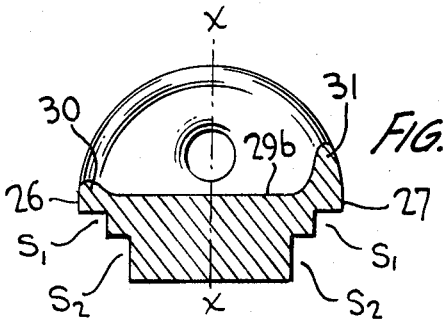
FIG. 6 shows a cross-section through the crucible of FIG. 3 as seen along lines 6—6.
Figure 7:
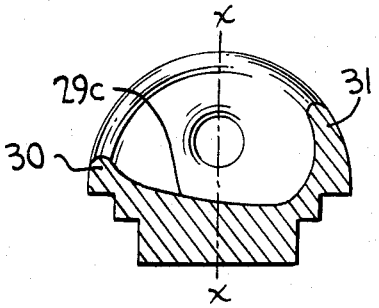
FIG. 7 shows a cross-section through the crucible of FIG. 3 as seen along line 7—7.
Figure 8:
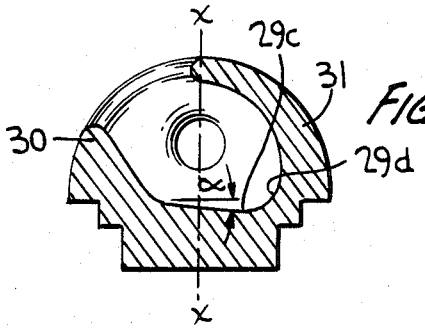
FIG. 8 shows a cross-section through the crucible of FIG. 3 as seen along lines 8—8.

As can be best seen in FIGS. 6–8, the right-side wall 31 is always correspondingly higher than the left-side wall 30. At the same time, both the left and right-side walls increase in height as they extend toward the front end of the crucible and they concurrently slope over toward one another until they merge at point A on the head portion 32. Point A is located on the left side of of the crucible, i.e., to the left of the imaginary vertical plane X. Due to the relative configurations of the left and right side walls 30 and 31, the crucible floor 29 is more exposed from the left side of the crucible than the right side, while at the same time the right side wall provides more of an enclosure, i.e., so as to better prevent molten metallic materials from splashing out of the crucible.

Considering now the contour of the crucible force 29, which extends from the rear end of the crucible toward the front end where it merges with the inner surface of the head portion 32 which forms the generally funnel-shaped channel C, it defines a generally horizontal first portion **29*a*, a generally flat second portion 29*b* and a generally flat third portion 29*c* (see FIG. 5). The second portion 29*b* narrows in width as it extends toward the front end of the crucible and it slopes downwardly with respect to horizontal at an angle $\phi$ of about 15° (note: in other embodiments of the invention this angle $\phi$ can be as low as 10° and as high as 20°). The third portion 29*c*, which also narrows in width as it extends toward the front end of the crucible, concurrently slopes both downwardly with respect to horizontal at an angle $\beta$ of about 3° and downwardly toward the right side of the crucible at an angle $\alpha$ (see FIG. 8) of about 3° so as to provide a lowermost area 29***d* of the crucible floor which is located on the right side of the crucible and within the head portion 32. The angle $\beta$ can vary between 2 and 6° and the angle $\alpha$ can also vary between about 2 and 6° . The provision of the lowermost area 29*d* of the crucible floor 29 is an essential feature of the present invention.

In its intended use, the crucible 20 is mounted on the support rails of a swing arm of a broken arm-type centrifugal casting machine, its nose 34 being directed toward the circular opening of a casting mold, and solid metallic material is placed on the floor 29. A flame is then directed at the solid metallic material from a point above the rear end of the crucible, and because of the low sloping angles of the floor portions 29*b* and 29*c* and the enhanced exposure of the floor 29 from the left side of the crucible, the heat from the flame will quickly and easily melt the solid metallic material. This molten metallic material will then immediately flow to the lowermost area 29*d* of the floor 29. After the flame treatment is terminated, the casting arm is caused to rotate (see FIG. 2) and the molten metallic material pooled in the lowermost area 29*d* will flow smoothly along the generally funnel-shaped C, through the discharge opening 33, through the nose 34 and into the casting mold. No molten metallic material will splash out of the crucible, in part as a result of the enclosing configuration of the head portion 32 and the right-side wall 31 over lowermost area 29*d*.

Figure 9:
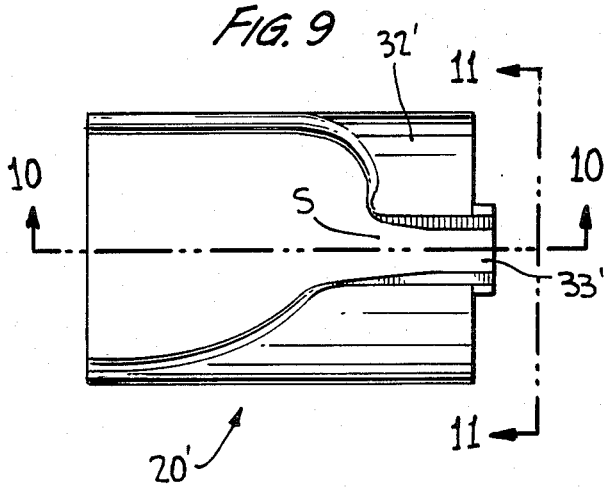
FIG. 9 shows a plan view of a crucible according to a second embodiment of the present invention.
Figure 11:
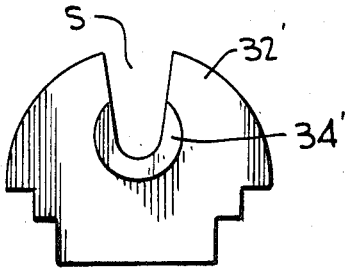
FIG. 11 shows a cross-section of the crucible of FIG. 9 as seen along line 11—11.
Figure 10:
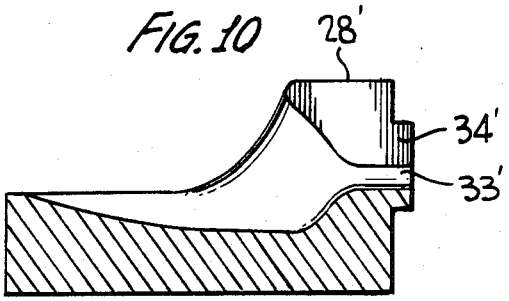
FIG. 10 shows a cross-section of the crucible of FIG. 9 as seen along line 10—10.

Turning now to the second preferred crucible embodiment shown in FIGS. 9–11, it is very similar to that shown in FIGS. 1 and 3–8; however, the cavity which extends along this crucible embodiment provides an upwardly expanding slot S in the head portion 32', the slot S extending between the inner surface in the head portion 32' and the top surface 28'. The slot S provides an escape route for gases produced by a flame directed at the metallic materials on the crucible floor. The slot S communicates with the front surface 23' of the crucible such that the discharge opening 33' has a circular bottom portion and a vertically expanding upper portion. The nose 34' is suitably shaped to surround the circular bottom portion of the discharge opening.

Although two preferred embodiments of the present invention have been shown and described in detail, various modifications can be made therein and still fall within the scope of the appended drawings.

I claim:

1. A crucible in which metallic materials can be melted and which is adapted to be used on a broken arm-type centrifugal casting machine so as to supply molten metallic materials to a casting mold, said crucible including an elongated base section and a top section, said top section being generally in the form of a half cylinder, said base section and said top section providing the crucible with a front surface at its front end, a rear surface at its rear end, a bottom surface, left and right sides and a curved top surface; a cavity which extend along the crucible from its rear end to its front end and in effect results in removal of a large portion of said top section, said cavity providing an exposed crucible floor, left and right side walls and a generally funnel-shaped channel in a head portion of said top section, said generally funnel-shaped channel extending to said front surface to provide a discharge opening therein which is centered with respect to an imaginary vertical plane which divides the crucible in half along its longitudinal dimension, said right wall being always correspondingly higher than said left side wall and each of said left and right side walls increasing in height and sloping over toward each other as they extend toward the front end of the crucible, and said crucible floor, which extends from the rear end of the crucible to a point within the head portion of the top section, including a portion which extends downwardly from horizontal as it slopes toward the front end of the crucible and concurrently downwardly toward the right side of the crucible so as to provide a lowermost area of said crucible floor within the head portion of said top section.

2. The crucible as defined in claim 1 wherein said crucible floor, as it extends toward the front end of the crucible, defines a generally horizontal first portion, a generally flat second portion, and a generally flat third portion, said third portion sloping downwardly from horizontal as it extends toward the front end of the crucible and concurrently downwardly toward the right side of the crucible.

3. The crucible as defined in claim 2 wherein said generally flat second floor portion narrows in width as it extends toward the front end of the crucible and it slopes downwardly with respect to horizontal at an angle of between 10 and 20°.

4. The crucible as defined in claim 3 wherein said angle is about 15°.

5. The crucible as defined in claim 3 wherein said generally flat third floor portion narrows in width as it extends toward the front end of the crucible and it slopes downwardly from horizontal at an angle of between about 2 and 6° and concurrently toward the right side of the crucible at an angle of between about 2 and 6°.

6. The crucible as defined in claim 5 wherein said front surface is generally vertical, said rear surface is generally vertical and said bottom surface is generally horizontal.

7. The crucible as defined in claim 6 wherein said discharge opening is circular.

8. The crucible as defined in claim 7 wherein the crucible includes a ring-like nose which extends forwardly of the front surface and is aligned with said circular discharge opening, the ring-like nose having an inner diameter which is equal to the diameter of said discharge opening.

9. The crucible as defined in claim 8 wherein said left and right side walls meet at a point on the head portion of said top section which is on the left side of said imaginary vertical plane.

* * * * *